US006685557B1

(12) United States Patent
Hoffe

(10) Patent No.: US 6,685,557 B1
(45) Date of Patent: Feb. 3, 2004

(54) BUILDING VENTILATION AIR INLET ASSEMBLY

(76) Inventor: Darius Hoffe, 42906 Colony Rd., Olivet, SD (US) 57052

( * ) Notice: Subject to any disclaimer, the term of this patent is extended or adjusted under 35 U.S.C. 154(b) by 0 days.

(21) Appl. No.: 10/320,561

(22) Filed: Dec. 13, 2002

(51) Int. Cl.[7] ..... F24F 7/00
(52) U.S. Cl. ..... 454/259; 454/360; 137/527.8
(58) Field of Search ..... 454/259, 270, 454/271, 273, 275, 276, 303, 360; 137/527.8

(56) References Cited

U.S. PATENT DOCUMENTS 3,159,090 A 12/1964 Schutt
4,794,852 A 1/1989 Ee
4,811,656 A 3/1989 Meendering
4,823,679 A 4/1989 Robbins
5,195,927 A * 3/1993 Raisanen ..... 454/271
5,201,685 A * 4/1993 Raisanen ..... 454/259
5,236,391 A 8/1993 Schaefer
5,277,658 A * 1/1994 Goettl ..... 454/259
5,735,086 A 4/1998 Fordahl
5,803,805 A 9/1998 Sells
5,989,119 A 11/1999 Raisanen
6,533,656 B2 * 3/2003 Hertel ..... 454/259

* cited by examiner

*Primary Examiner*—Jiping Lu

(57) ABSTRACT

A building ventilation air inlet assembly for providing an adjustable venting assembly to permit automatic inlet of air includes a housing, an air opening extending through the housing, a valve plate pivotally coupled to the housing for selectively covering the air opening, an adjustable valve counterweight coupled to the valve plate for biasing the valve plate into a closed position, and a valve plate stop lanyard coupled between the valve plate and the housing for restricting opening of the valve plate. The valve plate stop lanyard includes a clip member for permitting adjustment of the effective length of the valve plate stop lanyard.

12 Claims, 9 Drawing Sheets

BUILDING VENTILATION AIR INLET ASSEMBLY

BACKGROUND OF THE INVENTION

1. Field of the Invention

The present invention relates to building air inlets and more particularly pertains to a new building ventilation air inlet assembly for providing an adjustable venting assembly to permit automatic inlet of air.

2. Description of the Prior Art

The use of building air inlets is known in the prior art. U.S. Pat. No. 5,989,119 describes a device with pivoted valve plates and a cable for selectively opening the valve plates. Further, counterweights attached to the valve plates are stopped by physically contacting an incrementally adjustable valve plate stop assembly. Another type of building air inlets is U.S. Pat. No. 5,236,391 having hinged doors biased into a closed position by springs. U.S. Pat. No. 4,823,679 and U.S. Pat. No. 4,794,852 also show an air inlet having a door biased by a spring. U.S. Pat. No. 4,811,656 discloses a vertically oriented pivoting door to permit air flow into a room based on negative air pressure within the room. U.S. Pat. No. 5,803,805 and U.S. Pat. No. 3,159,090 show air inlets utilizing ball valve type inlets. U.S. Pat. No. 5,735,086 discloses an attic access hatch incorporating air venting structure.

While these devices fulfill their respective, particular objectives and requirements, the need remains for an air inlet that is easily adjusted and provides improved ability to restrict opening of valve plates or doors. Additionally, use of polystyrene and foam provides enhanced aesthetic value, lessens cost, and provides a more easily adjusted system by reducing weight of the valve plates or doors.

SUMMARY OF THE INVENTION

The present invention meets the needs presented above by providing an adjustable length lanyard having one end coupled to the valve plate and another end coupled to a housing fitted to the building. A clip member is positionable at a selectable position anywhere along an end portion of the lanyard to restrict opening of the valve plate. Further, the invention utilizes polystyrene and foam to provide sturdy yet lightweight valve plates.

Still yet another object of the present invention is to provide a new building ventilation air inlet assembly that opens only upon a condition of having negative air pressure within a room.

Even still another object of the present invention is to provide a new building ventilation air inlet assembly that physically and directly restricts motion of the valve plates to permit adjustment to any desired maximum opening position of the valve plates.

Still even another object of the present invention is to position the valve plate stopping lanyard and clip member to permit quick and easy two hand adjustment of the effective length of the valve plate stop lanyard by either opening of the valve plate to a desired maximum opening position or pulling the lanyard to until the valve plate is set at the desired maximum opening position.

To this end, the present invention generally comprises a housing, an air opening extending through the housing, a valve plate pivotally coupled to the housing for selectively covering the air opening, an adjustable valve counterweight coupled to the valve plate for biasing the valve plate into a closed position, and a valve plate stop lanyard coupled between the valve plate and the housing for restricting opening of the valve plate. The valve plate stop lanyard includes a clip member for permitting adjustment of the effective length of the valve plate stop lanyard.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
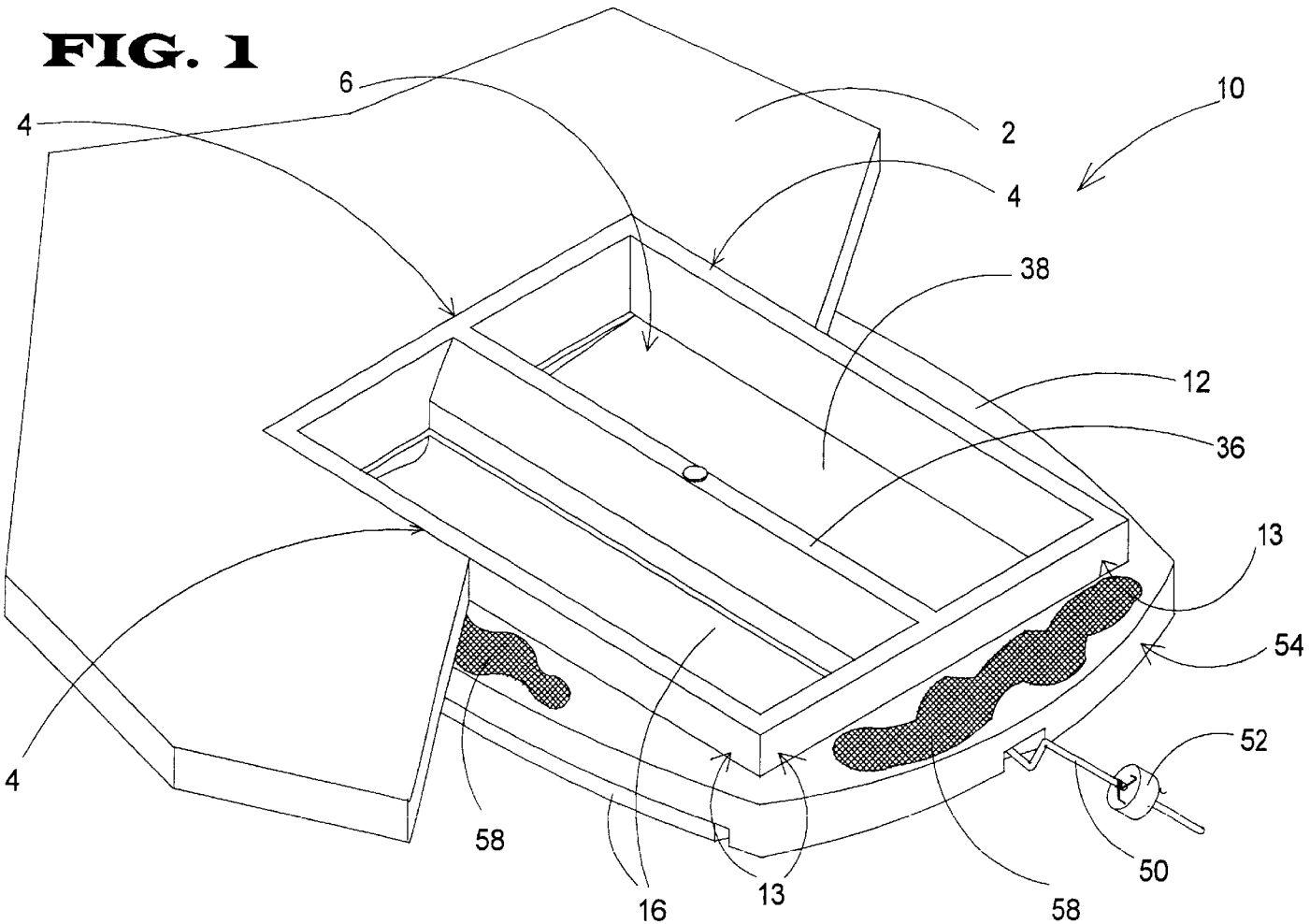
FIG. 1 is a perspective view of a new building ventilation air inlet assembly according to the present invention.
Figure 2:
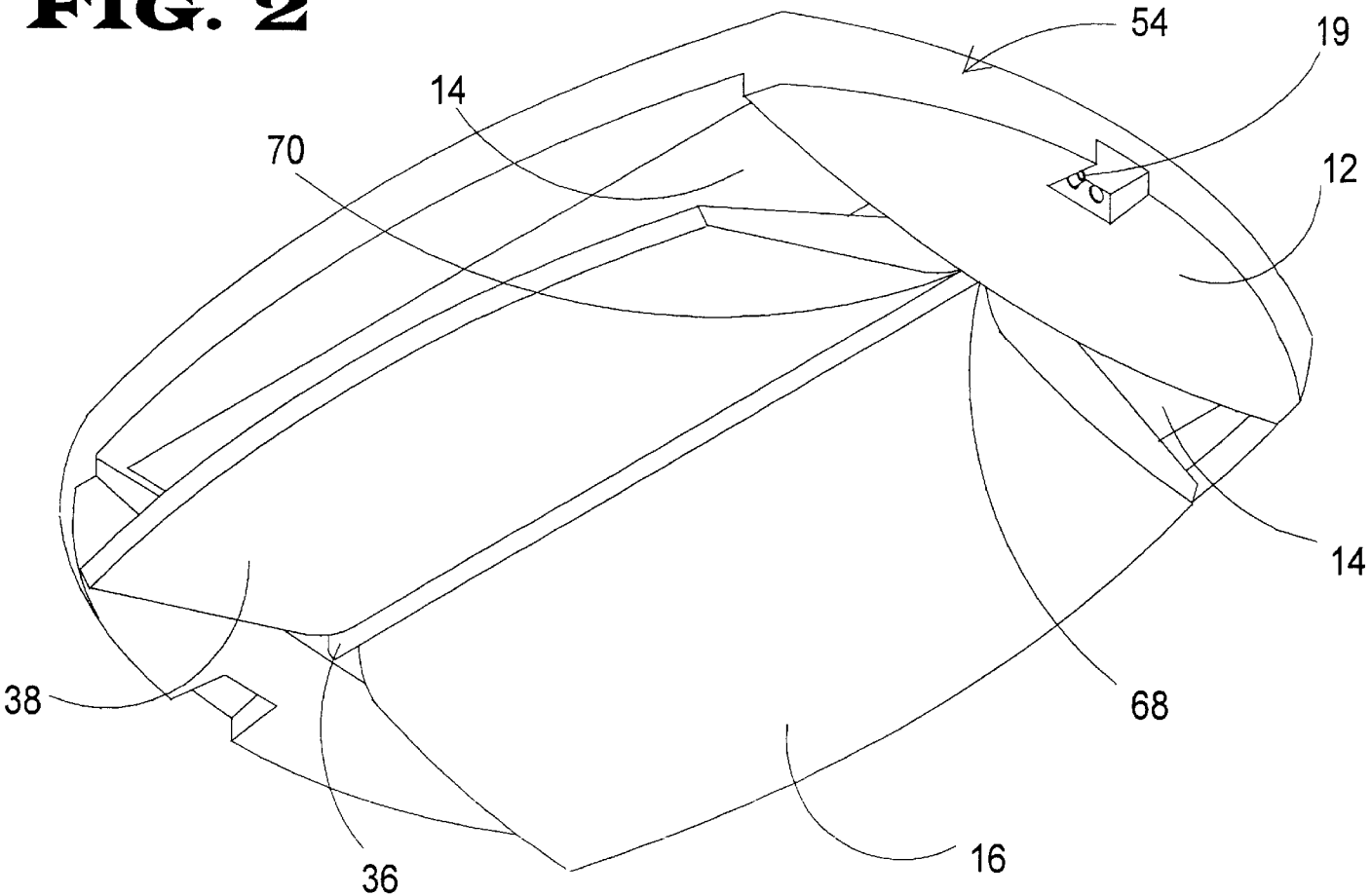
FIG. 2 is a perspective view of the present invention in an open position.
Figure 3:
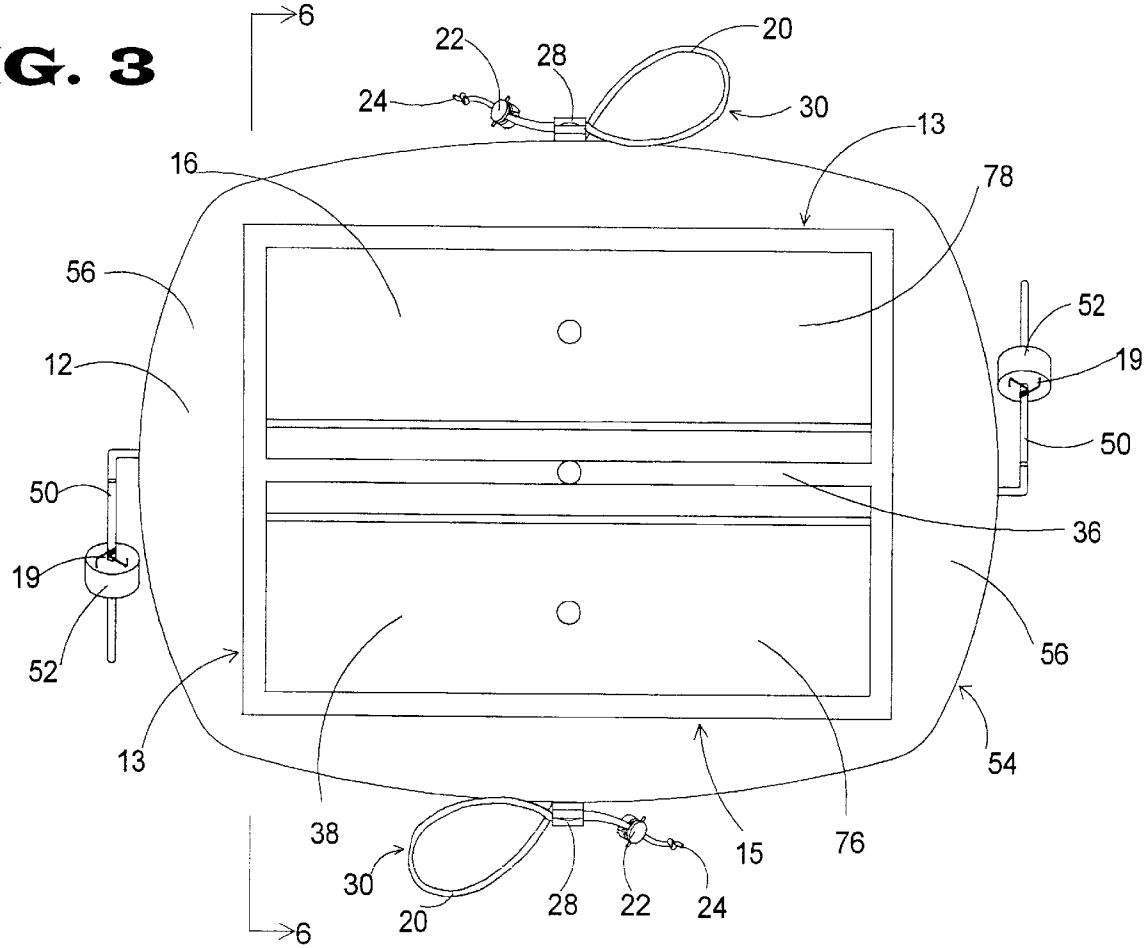
FIG. 3 is a top view of the present invention.
Figure 4:
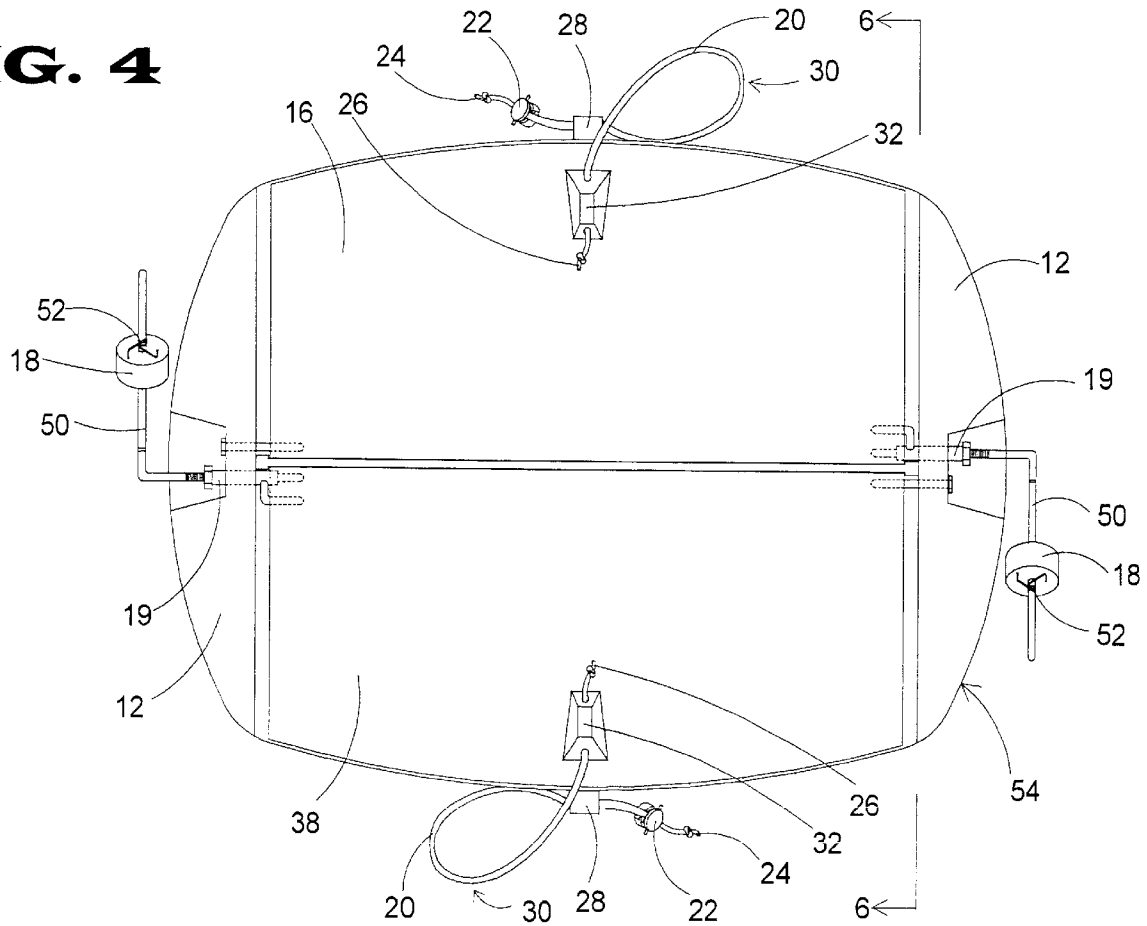
FIG. 4 is a bottom view of the present invention.
Figure 5:
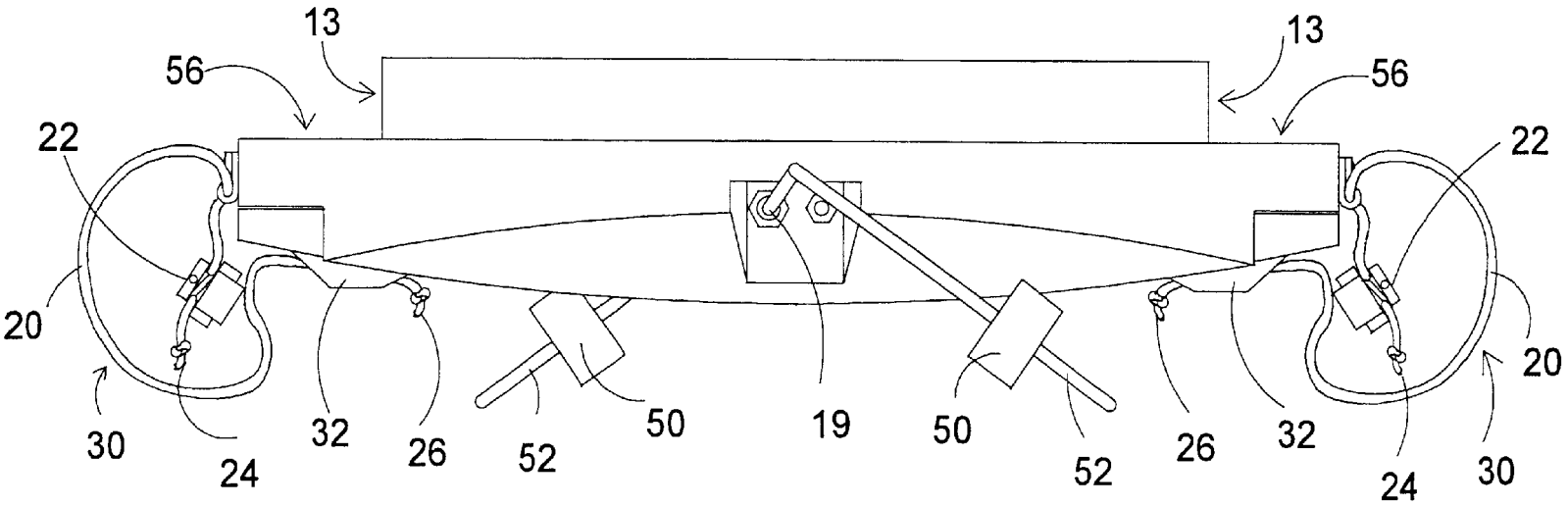
FIG. 5 is an end view of the present invention.
Figure 6:
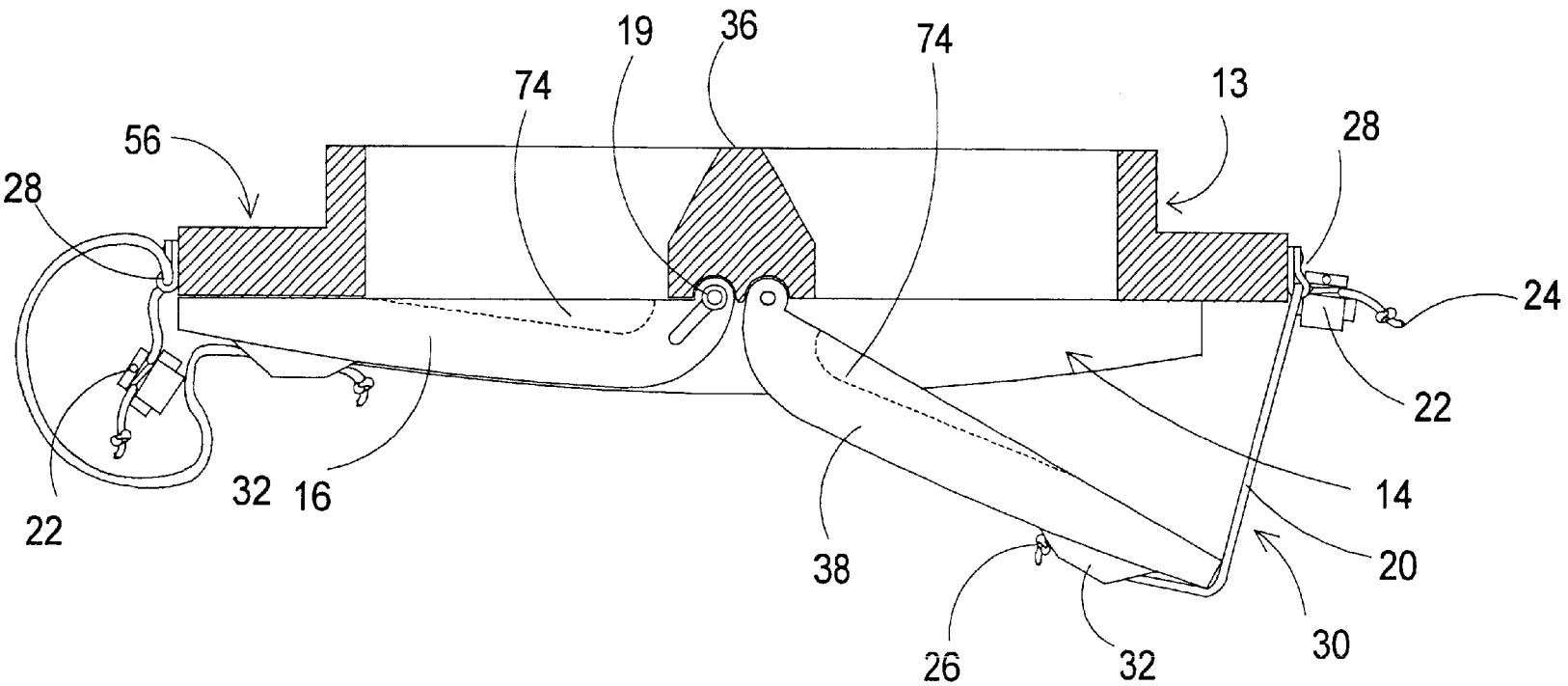
FIG. 6 is a cross-sectional view of the present invention taken along line 6—6 of FIG. 4.
Figure 7:
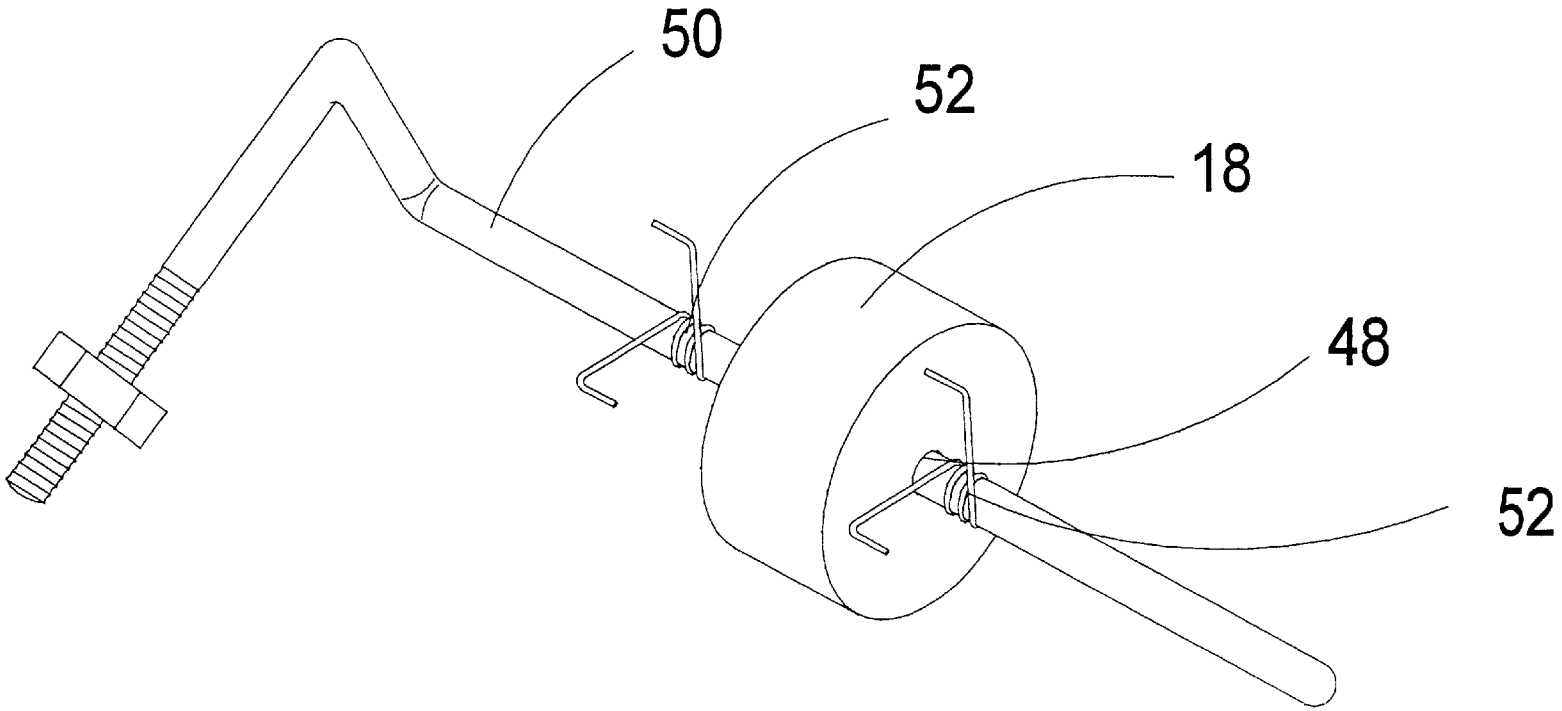
FIG. 7 is a perspective view of the counterweight and counterweight arm of the present invention.
Figure 8:
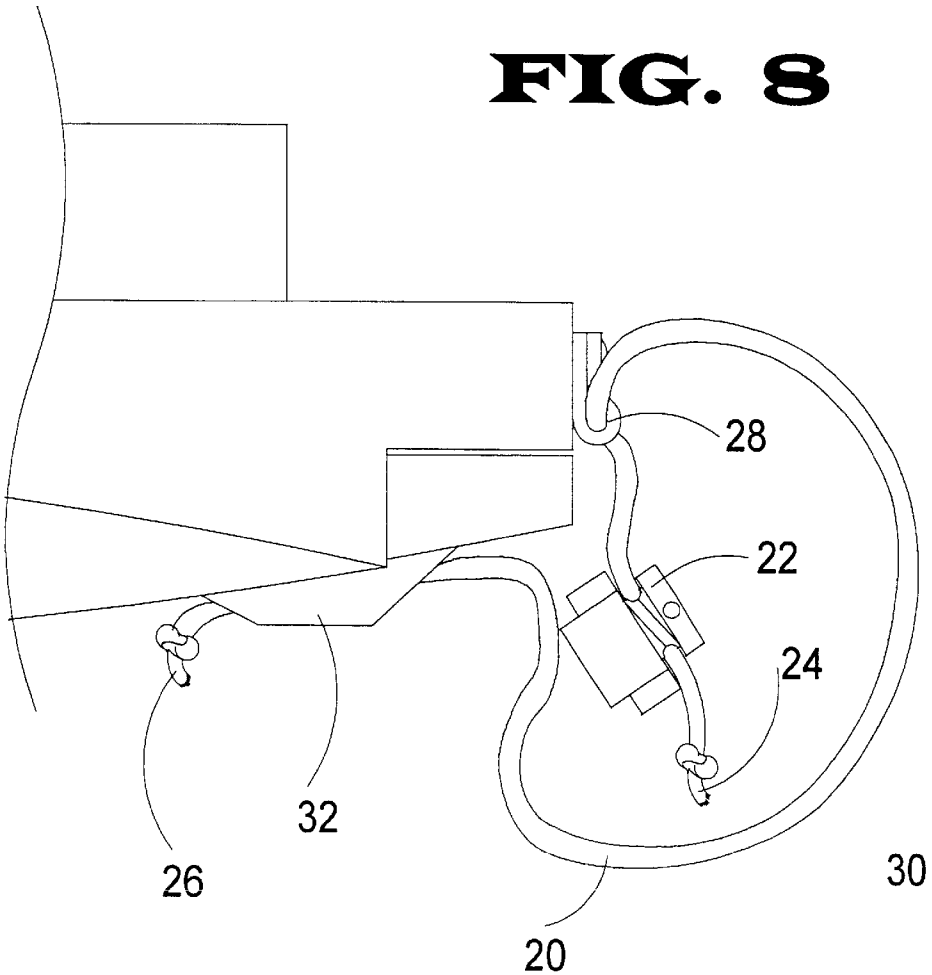
FIG. 8 is a side view of the valve plate stop lanyard assembly of the present invention.
Figure 9:
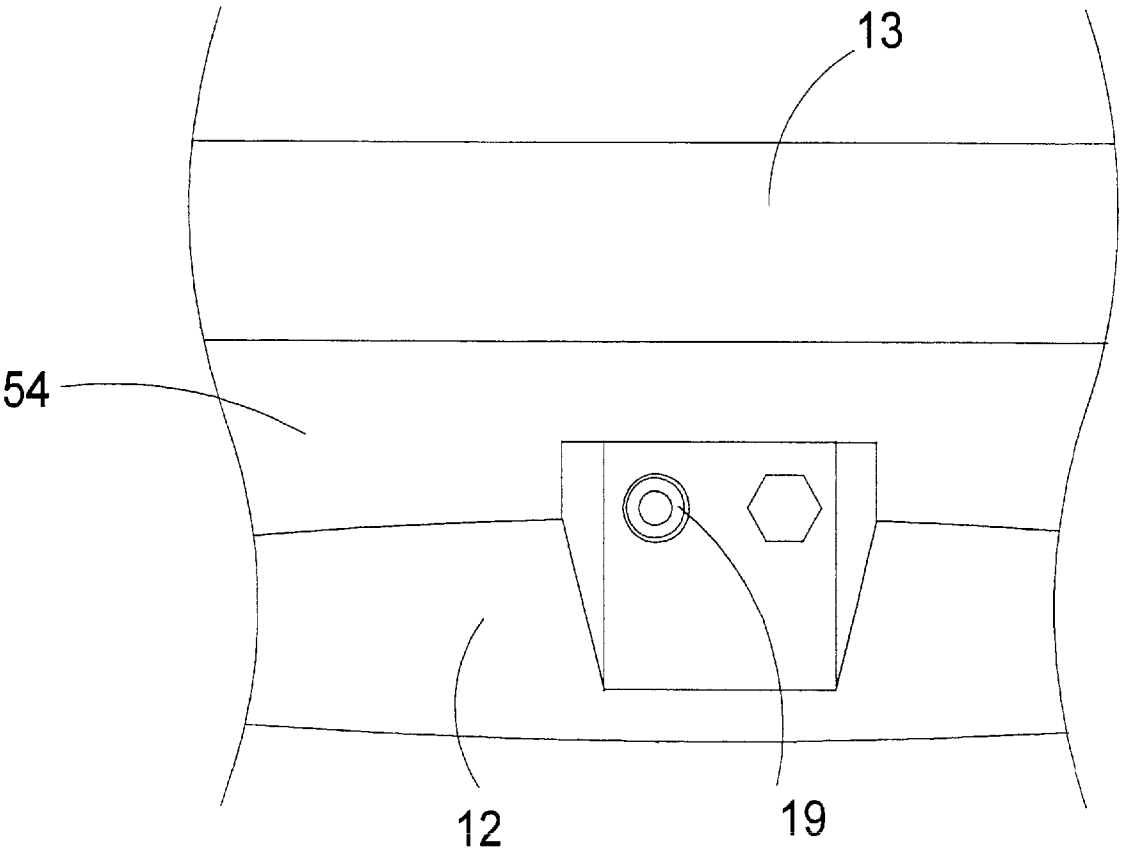
FIG. 9 is an end view of the housing of the present invention.

With reference now to the drawings, and in particular to FIGS. 1 through 9 thereof, a new building ventilation air inlet assembly embodying the principles and concepts of the present invention and generally designated by the reference numeral 10 will be described.

As best illustrated in FIGS. 1 through 9, the building ventilation air inlet assembly 10 generally comprises a housing 12 designed for coupling to a building 2. The housing 12 is structured to include an air opening 14 extending through the housing 12. A valve plate 16 is pivotally coupled to the housing 12 for selectively covering the air opening 14. A valve counterweight 18 is coupled to the valve plate 16 for biasing the valve plate 16 into a closed position. The valve counterweight is lifted as differences in air pressure open the valve plate. A valve plate stop lanyard 20 is coupled between the valve plate 16 and the housing 12 for restricting opening of the valve plate 16. A clip member 22 is coupled to a selectable position along the valve plate stop lanyard 20 for permitting adjustment of an effective length of the valve plate stop lanyard 20. The valve plate stop lanyard 20 has a first end 24 and a second end 26.

In an embodiment, the first end 24 is coupled to the valve plate 16 in a relatively static position. The first end 24 may be fixed or pass through a conduit and include a means for stopping the first end from passing through the conduit when tension is put on the valve plate stop lanyard 20. The housing 12 includes a housing loop portion 28. A medial portion 30 of the valve plate stop lanyard 20 passes through the housing loop portion 28 and the clip member 22 is coupled to the valve plate stop lanyard 20 between the second end 26 and the housing loop portion 28 such that the clip member 22 prevents the second end 26 from passing through the housing loop portion 28. Thus, the valve plate 16 is restricted from opening further when the clip member 22 abuts the housing loop portion 28.

Alternately, the second end 26 is coupled to the housing 12 as described above and the valve plate 16 includes a valve plate loop portion 32. The medial portion 30 of the valve plate stop lanyard 20 passes through the valve plate loop portion 32 and the clip member 22 is coupled to the valve plate stop lanyard 20 between the first end 24 and the valve plate loop portion 32 such that the clip member 22 prevents the first end 24 from passing through the valve plate loop portion 32. Thus, the valve plate 16 is restricted from opening further when the clip member 22 abuts the valve plate loop portion 32.

In the most preferred form the air opening 14 is a first air opening, the valve plate 16 is a first valve plate, the counterweight 18 is a first counterweight, the valve plate stop lanyard 20 is a first valve plate stop lanyard, and the clip member 22 is a first clip member. The housing 12 is structured to include a second air opening 34 positioned adjacent the first air opening 14 such that a cross beam 36 extends across the housing 12 between the first and second air openings 14 and 34. A second valve plate 38 is pivotally coupled to the housing 12. Each of the first and second valve plates 16 and 38 include a connection portion, 40 and 42 respectively, extending from a main portion 44 and 46, respectively. Each connection portion 40,42 is recessed into the cross beam 36 for facilitating sealing of the first and second valve plates 16,38 when each of the first and second valve plates 16,38 is in the closed position.

Counterweight 18 has a counterweight opening 48 extending through the counterweight 18. Each valve plate has an associated counterweight 18 of similar structure. A counterweight attachment arm 50 is coupled to the valve plate 16. The counterweight attachment arm 50 is slidably inserted through the counterweight opening 48. A pair of counterweight stop members 52 are provided. Each counterweight stop member 52 is engageable to a selectable position along the counterweight attachment arm 50. Thus, the counterweight 18 is selectively positionable at a desired point between along the counterweight attachment arm 50 between the pair of counterweight stop members 52. The counterweight stop members 52 are most preferably a form of spring clip manipulatable by a single hand.

The housing 12 includes perimeter portion 54 extending radially from the housing 12. The perimeter portion 54 has an upper surface 56. Thus, the housing 12 is designed for being coupled to the building 2 such that the upper surface 56 of the perimeter portion 54 sealingly engages a perimeter area 4 of an opening 6 in the building 2 to facilitate installation of the housing 12. Most preferably, an adhesive 58 is positioned on the upper surface 56 of the perimeter portion 54 of the housing 12. Thus,.the upper surface 56 sealingly engages the perimeter area 4 of the opening 6 of the building 2.

Each of the first and second valve plates 16,38 has a respective proximal edge 60,62 positioned adjacent the cross beam 36. Each of the first and second valve plates 16,38 is tapered extending orthogonally from the proximal edge 60,62 towards a distal edge 64,66 for reducing weight of the valve plates 16,38 approaching the distal edge 64,66.

Each of the first and second valve plates 16,38 has a respective arcuate outer surface portion 68,70 extending from the respective proximal edge 60,62 for preventing the first and second valve plates 16,38 from interfering with simultaneous opening of the first and second valve plates 16,38.

In an embodiment, each valve plate 16,38 has a scooped cavity 72,74 extending into an upper surface 76,78 of the valve plate for facilitating movement of air through the air opening 14,36 when the valve plate 16,38 is in an open position.

The housing 12 further includes an insertion portion 13 extending upwardly from an interior edge 15 of the perimeter portion 54 of the housing 12. The insertion portion 13 is configured such that the insertion portion 13 is designed for Inserting through the opening 6 in the building 2 to prevent misalignment of the perimeter portion 54 of the housing 12 around the opening 6 in the building 2.

In use, adhesive on the perimeter portion is pushed into contact with the area surrounding an opening in a building, typically an opening in a ceiling. The counterweight attachment arms 50 are threaded for engaging an axle 19 extending through the valve plate to form a hinge mechanism for the valve plate. An extension portion 21 extends from the axle 19 to engage the valve plate offset from the axis of rotation of the valve plate. The counterweight is positioned on the counterweight attachment arm to bias the valve plate into a naturally closed position. The counterweight is adjusted to set a desired force that must be overcome to permit the valve plate to pivot open to permit air to flow through the opening. The valve plate stop lanyard is adjusted to set a maximum opening. The clip member may be positioned at either end of the valve plate stop lanyard. Adjustment is made quickly and easily using the structure of the present invention by positioning the valve plate at the desired maximum opening position and setting the clip member. When negative air pressure is experienced and the valve plate is urged into an open position, the structure of the present invention permits easy adjustment by releasing the clip member, holding the clip member immediately adjacent to the loop portion used to stop the clip member, and pulling the valve plate stop lanyard until the valve plate is in the desired position. By utilizing a clip member manipulatable by one hand, this operation is particularly simplified compared to the prior art.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A building air inlet assembly comprising:

a housing adapted for coupling to a building, said housing being structured to include an air opening extending through said housing;

a valve plate pivotally coupled to said housing for selectively covering said air opening;

a valve counterweight coupled to said valve plate for biasing said valve plate into a closed position; and a valve plate stop lanyard coupled between said valve plate and said housing for restricting opening of said valve plate.

2. The building air inlet assembly of claim 1, further comprising:

a clip member coupled to a selectable position along said valve plate stop lanyard for permitting adjustment of an effective length of said valve plate stop lanyard.

3. The building air inlet assembly of claim 2 wherein said valve plate stop lanyard has a first end and a second end, said first end being coupled to said valve plate; and wherein said housing includes a housing loop portion, a medial portion of said valve plate stop lanyard passing through said housing loop portion, said clip member being coupled to said valve plate stop lanyard between said second end and said housing loop portion such that said clip member prevents said second end from passing through said housing loop portion whereby said valve plate is restricted from opening further when said clip member abuts said housing loop portion.

4. The building air inlet assembly of claim 2 wherein said valve plate stop lanyard has a first end and a second end, said second end being coupled to said housing; and wherein said valve plate includes a valve plate loop portion, a medial portion of said valve plate stop lanyard passing through said valve plate loop portion, said clip member being coupled to said valve plate stop lanyard between said first end and said valve plate loop portion such that said clip member prevents said first end from passing through said valve plate loop portion whereby said valve plate is restricted from opening further when said clip member abuts said valve plate loop portion.

5. The building air inlet assembly of claim 2, further comprising:

said air opening being a first air opening, said valve plate being a first valve plate, said counterweight being a first counterweight, said valve plate stop lanyard being a first valve plate stop lanyard, and said clip member being a first clip member;

said housing being structured to include a second air opening positioned adjacent said first air opening such that a cross beam extends across said housing between said first and second air openings;

a second valve plate pivotally coupled to said housing;

each of said first and second valve plates having a connection portion extending from a main portion, each said connection portion being recessed into said cross beam for facilitating sealing of said first and second valve plates when each of said first and second valve plates is in said closed position.

6. The building air inlet assembly of claim 2, further comprising:

said air opening being a first air opening, said valve plate being a first valve plate, said counterweight being a first counterweight, said valve plate stop lanyard being a first valve plate stop lanyard, and said clip member being a first clip member;

said housing being structured to include a second air opening positioned adjacent said first air opening such that a cross beam extends across said housing between said first and second air openings;

a second valve plate pivotally coupled to said housing;

each of said first and second valve plates having a respective proximal edge positioned adjacent said cross beam;

each of said first and second valve plates being tapered extending orthogonally from said proximal edge towards a distal edge for reducing weight of said valve plates, approaching said distal edge.

7. The building air inlet assembly of claim 6, further comprising:

each of said first and second valve plates having a respective arcuate outer surface portion extending from said respective proximal edge for preventing said first and second valve plates from interfering with simultaneous opening of said first and second valve plates.

8. The building air inlet assembly of claim 1, further comprising:

said counterweight having a counterweight opening extending through said counterweight;

a counterweight attachment arm coupled to said valve plate, said counterweight attachment arm being slidably inserted through said counterweight opening; and a pair of counterweight stop members, each counterweight stop member being engageable to a selectable position along said counterweight attachment arm whereby said counterweight is selectively positionable at a desired point between along said counterweight attachment arm between said pair of counterweight stop members.

9. The building air inlet assembly of claim 1 wherein said housing includes perimeter portion extending radially from said housing, said perimeter portion having an upper surface whereby said housing is adapted for being coupled to the building such that said upper surface of said perimeter portion sealingly engages a perimeter area of an opening in the building to facilitate installation of said housing.

10. The building air inlet assembly of claim 9 further comprising:

an adhesive positioned on said upper surface of said perimeter portion of said housing whereby said upper surface sealingly engages the perimeter area of the opening of the building.

11. The building air inlet assembly of claim 9 wherein said housing further includes an insertion portion extending upwardly from an interior edge of said perimeter portion of said housing, said insertion portion being configured such that said insertion portion is adapted for inserting through the opening in the building to prevent misalignment of said perimeter portion of said housing around the opening in the building.

12. The building air inlet assembly of claim 1 wherein said valve plate has a scooped cavity extending into an upper surface of said valve plate for facilitating movement of air through said air opening when said valve plate is in an open position.

* * * * *